United States Patent [19]

Konigsford et al.

[11] 4,109,795

[45] Aug. 29, 1978

[54] DISPLAY RACK AND ASSEMBLY OF ARTICLES ON THE RACK

[75] Inventors: Barry S. Konigsford, Mount Prospect; Kenneth Davidson, Libertyville; Howard J. Marschak, Evanston, all of Ill.

[73] Assignee: International Telephone and Telegraph Corporation, New York, N.Y.

[21] Appl. No.: 595,736

[22] Filed: Jul. 14, 1975

[51] Int. Cl.[2] ..... A47F 7/00

[52] U.S. Cl. ..... 211/57.1; 206/554

[58] Field of Search ..... 211/54, 57, 59, 6, 7, 211/123, 60, 105.1; 248/DIG. 3, 99–101, 223, 224, 216, 219, 225, 220.5; 221/26, 312 R, 312 A, 312 C; 206/493, 526, 801, 806

[56] References Cited

U.S. PATENT DOCUMENTS

| | | | |
|---|---|---|---|
| 920,132 | 5/1909 | Greener | 211/57 |
| 1,184,735 | 5/1916 | Freid | 211/57 X |
| 1,416,969 | 5/1922 | O'Connor | 211/59 |
| 2,247,497 | 7/1941 | Howell et al. | 211/57 |
| 2,273,668 | 2/1942 | Steiner | 211/57 X |
| 2,943,743 | 7/1960 | Thorson | 211/59 |
| 3,211,293 | 10/1965 | Tarnoff | 211/59 |
| 3,534,864 | 10/1970 | Larson | 211/57 |
| 3,646,723 | 3/1972 | Meroney | 206/801 X |
| 3,696,937 | 10/1972 | Braverman | 211/54 |

FOREIGN PATENT DOCUMENTS

| | | | |
|---|---|---|---|
| 437,348 | 4/1912 | France | 24/155 B |
| 184,052 | 7/1936 | Switzerland | 85/21 |

*Primary Examiner*—Roy D. Frazier
*Assistant Examiner*—Terrell P. Lewis
*Attorney, Agent, or Firm*—James B. Raden; Harold J. Holt

[57] ABSTRACT

An arrangement is shown for displaying and dispensing articles together with apparatus and a method for assembling the articles for display. Included is a plurality of rods mounted by first ends on boards to serve as brackets, with second ends below the first and pointing away from the boards. The rods incorporate detents to prevent packages from slipping off. Mounting members are used to support pre-prepared assemblages of packages and the assemblages are slid-off the mounting means onto the brackets to prepare displays.

7 Claims, 5 Drawing Figures

DISPLAY RACK AND ASSEMBLY OF ARTICLES ON THE RACK

BACKGROUND OF THE INVENTION

1. Field of the Invention

The invention relates to the display and dispensing of articles. In particular, it relates to means enabling the display and dispensing of packaged articles supported on brackets, or display rack hooks, and to means enabling the ready and efficient placement of pluralities of packages on the brackets.

2. Description of the Prior Art

The prior art includes arrangements for displaying packaged articles held on supporting arms and the like. Such displays are usually provided in stores and shops to draw attention of customers and enable self-service by the customers. Any customer desiring to make a purchase may easily remove the required package from the supporting arm. When an arm is empty, packages are replaced one at a time by clerks or other store personnel. The present invention eliminates the requirement that packages be replaced one at a time by providing means to enable replacement of packages in groups of ten or so at a time.

The closest known prior art is disclosed in a patent to Tarnoff, U.S. Pat. No. 3,211,293, which is directed to "Rack Mountable Articles of Manufacture." The apparatus shown by Tarnoff includes rod-like brackets having bent offsets, or elbows, which are used to retain packages in place on the brackets. Tarnoff employs tubular rods having flared ends to support groups of packages before they are placed on the brackets. The flared ends of the tubular rods are used also to engage the ends of the brackets and complete a path over which the packages may be moved from the tubular rods onto the brackets.

SUMMARY OF THE INVENTION

It is an object of the present invention to provide a novel apparatus and arrangement for displaying and dispensing articles. It is a further object to provide a novel apparatus and arrangement for supporting a plurality of articles as a group before they are placed in a rack and to enable the plurality of articles to be placed on the rack as a group for display.

The foregoing objects and others ancillary thereto are preferably attained with the present invention by use of a plurality of brackets affixed by first ends to a pegboard or the like and having free ends which are sized to fit apertures in a plurality of articles or packages containing articles. The free ends of the brackets are equipped with notches and upset portions which serve as retaining means to prevent the articles or packages from sliding off the brackets until they are deliberately lifted free of the notches and upset portions. An arrangement, including a "straw" or hollow rod, is provided by means of which a plurality of packages may be extracted as groups from boxes and placed on the brackets in groups with a minimum expenditure of time and energy.

BRIEF DESCRIPTION OF THE DRAWINGS

The above mentioned and other features and objects of this invention and the manner of obtaining them will become more apparent, and the invention itself will be best understood by reference to the following description of an embodiment of the invention taken in conjunction with the accompanying drawings, in which.

DESCRIPTION OF PREFERRED EMBODIMENT

Figure 1:
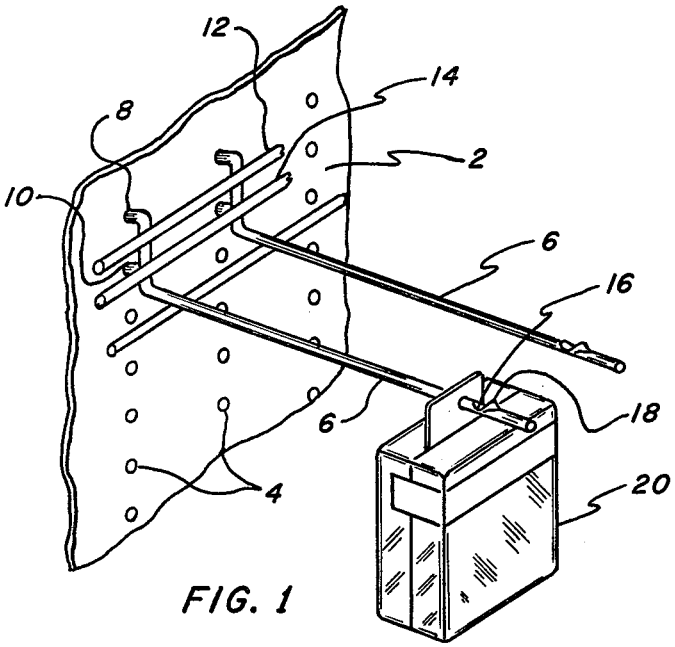
FIG. 1 shows a perspective view of a display rack or board with a display rack hook, or bracket, supporting a package in position on the display board in accordance with the invention.

Turning now to FIG. 1, there is shown a pegboard, or similar structure, at 2 having an array of apertures, or holes, situated therethrough as indicated at 4. A plurality of brackets, or display rack hooks, such as 6 includes extensions 8 and 10 which are inserted through selected openings 4 to secure the brackets 6 to the board 2. In a preferred embodiment, the desired brackets or hooks would be fastened together by welded rods, or the like, such as are indicated at 12 and 14 so that they may be mounted on boards 2 as large stable units.

Each display rack hook, or bracket, includes a stop-notch 16 and a protrudence 18, formed of upset material, which together serve as a detent to prevent packages such as box 20 from sliding off the rack hook. Other packages or articles having holes therethrough such as blister-cards or envelopes may also be assembled and held on the disclosed hooks or brackets.

Figure 2:
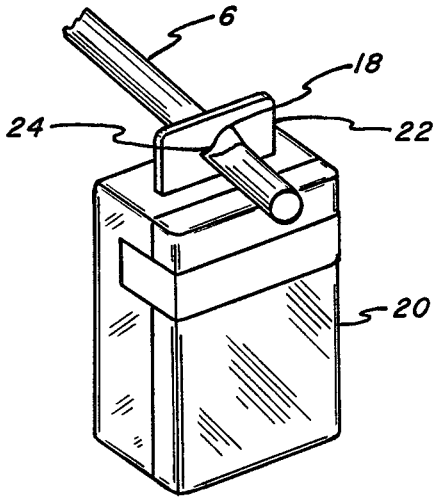
FIG. 2 illustrates further details of the relationships between a package and a bracket, or display rack hook.
Figure 3:
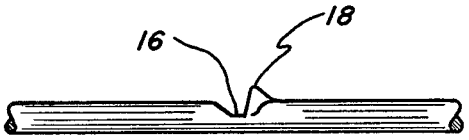
FIG. 3 shows further detailed relationships of a detent, formed by a notch and upset material, as it relates to a display rack bracket.

FIG. 2 is a detailed illustration of relationships between a display rack hook 6 and a box 20 showing how a hole, or aperture, 24, in the tab 22 of the box lodges in the stop-notch 16 against the body of upset material 18. It will be appreciated that the stop-notch 16 and protrudence 18, as shown more clearly in FIG. 3, will prevent the box 20 from sliding off the hook 6 and may retain additional boxes on the hook 6 behind the box 20.

Figure 4:
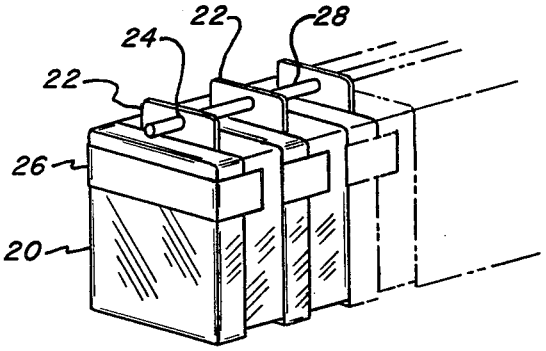
FIG. 4 illustrates an arrangement of packages, as taken from a box, and supported by a rod-shaped mounting member.

FIG. 4 is a perspective view showing a plurality, typically 10, of plastic boxes 20. These boxes 20 are shown mounted by apertures 24 on a round hollow kraft paper rod 28, which serves as a mounting member. The boxes occupy the same relative position in this view that they had when they were removed from a pak box. In this example, plastic boxes used for bolts, nuts, screws and the like are hinged along one side and are sealed shut by labels indicated at 26 so that they will not pop open inadvertently. It is intended that the boxes will be packed 10 or so to a carton or pak box enabling all the boxes in a particular carton to be strung on a "straw" or hollow rod 28 which may be packed one to a box or one for several cartons or pak boxes. Alternatively, the boxes may be packed and sold in an assembled relationship with a rod 28, which may be rigid or flexible in part, extending through the aligned holes ready for transfer to a display hook.

Figure 5:
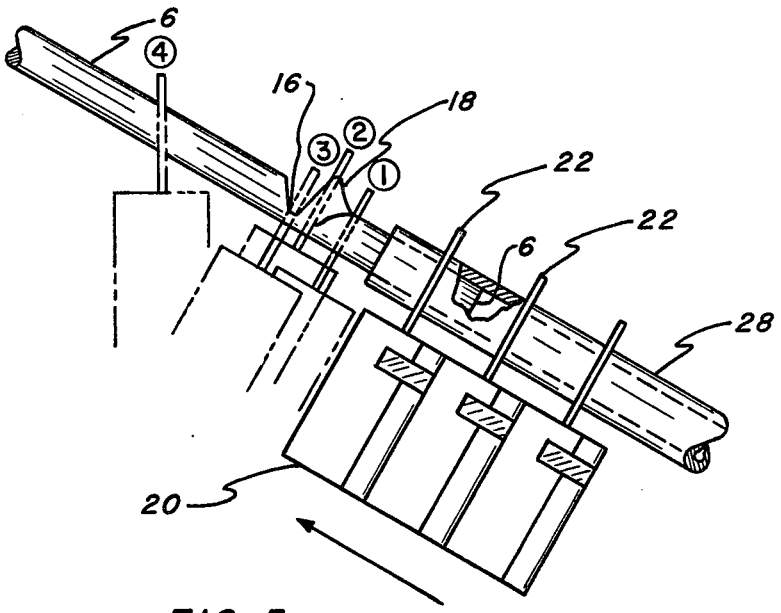
FIG. 5 shows a mounting member in engagement with a rack hook to enable packages to be transferred to the rack hook.

FIG. 5 illustrates how packages 20 assembled on a mounting member or hollow rod such as 28 may be moved onto a display rack hook, or bracket, such as 6. In this Figure, one end of a hollow tube 28, bearing an assemblage such as that of FIG. 4, is placed over the end of a bracket 6. The packages or boxes 20 are then pushed up over the upset material 18 and through the notch 16 onto the upper shank of 6, through successive stages as indicated at (1), (2), (3) and (4) by dashed lines in the drawings. The bracket 6 is loaded in this manner simply by pushing the packages in the direction of the arrow after which the rod 28 may be removed. The packages will then be held in place on the bracket by the notch 16 and upset material 18 until each of the packages is removed by being lifted out of the notch and up over the upset material past the free end of the bracket.

While the principles of the invention have been described above in connection with specific apparatus and applications, it is to be understood that this description is made only by way of example and not as a limitation on the scope of the invention.

We claim:

1. An arrangement comprising a bracket having first and second means supporting said bracket at a first end, said bracket being formed as a substantially straight element having a given cross-sectional area, said bracket incorporating detent means at the second end, said detent means including a stop-notch of reduced cross-sectional area, cooperative with an adjacent protuberance of increased cross-sectional area, the latter facing toward the second end of the bracket, and a mounting member supporting a plurality of articles, said mounting member including an end telescopically engageable with the second end of said bracket to enable said articles to be slid along a linear path from said mounting member over the detent means onto the bracket.

2. The invention as claimed in claim 1, in which the detent means limits the telescopic motion of said mounting member.

3. The invention as claimed in claim 1, in which the detent means prevents the articles from falling off the bracket and permits deliberate removal of the articles from the bracket.

4. A combination comprising a support, a substantially rigid straight rod having a given cross-sectional area having one end engaging said support and a free end extending away from said support, a notch of reduced cross-sectional area adjacent to and cooperative with an upset portion of increased cross-sectional area near the free end of said rod, a plurality of articles, each of said articles including a mounting aperture therein, and a tubular mounting member insertable through the apertures of said articles to align them along a common bore, said mounting member being telescopically movable over the free end of said rigid rod to the vicinity of the upset portion, whereby substantially the full extent of said rod remains free for reception of said aligned plurality of articles, said aligned plurality of articles being slidable in a continuous substantially linear path longitudinally of said mounting member and over said upset portion onto said rod when said mounting member is coupled to said rod.

5. The invention as claimed in claim 4, in which the rigid tubular mounting member is limited in its telescopic movement by said upset portion.

6. The invention as claimed in claim 4, in which the notch and upset portion form a detent and said detent prevents said articles from inadvertently sliding off the rod after they have been placed thereon while permitting deliberate removal of the articles.

7. A bracket for displaying and dispensing a plurality of articles, each of which is supported on a card having an opening, said bracket having spaced hooking members at the rear thereof for detachable securement to a pegboard to form a display rack, said bracket having a forwardly and longitudinally extending metal rod which is circular in cross-section with said metal rod having a depressed portion having a downwardly and angularly sloping surface terminating with the front thereof well into the rod body, a raised portion at the front of said depressed portion and rearward of the rod end, said raised portion having a wall surface extending from the juncture thereof with the depressed portion substantially perpendicular to the longitudinal axis of the rod and with said wall surface extending upwardly of the top plane of the rod, both said depressed and raised portions thereby forming a detent adjacent the forward end of the metal rod but spaced rearwardly from the front end of said rod, so that the cards which are hung on said metal rod through said card openings will be retained on said metal rod solely by said detent but will permit ready removal of the article and its card from the metal rod by lifting such article and card vertically upwardly of the metal rod, the most forward of said plurality of cards adapted to be received in said depressed portion of said rod when said card engages said detent while said card is supported on said rod, the longitudinal axis of the front end of said rod coinciding with the longitudinal axis of the major portion of the rod so that each of the cards may be inserted on said rod in a linear direction.

* * * * *